United States Patent [19]

Schaffer et al.

[11] Patent Number: 4,898,368

[45] Date of Patent: Feb. 6, 1990

[54] WEAR RESISTANT METALLURGICAL TUYERE

[75] Inventors: Paul J. Schaffer, Peekskill, N.Y.; Robert C. Tucker, Jr., Brownsburg, Ind.

[73] Assignee: Union Carbide Corporation, Danbury, Conn.

[21] Appl. No.: 236,788

[22] Filed: Aug. 26, 1988

[51] Int. Cl.[4] ..... C21C 5/48

[52] U.S. Cl. ..... 266/222; 266/268; 266/270

[58] Field of Search ..... 266/218, 222, 268, 270, 266/280

[56] References Cited

U.S. PATENT DOCUMENTS

| | | | |
|---|---|---|---|
| 942,661 | 12/1909 | Peirce | 266/270 |
| 3,898,079 | 8/1975 | Eriksson | 266/268 |
| 4,023,781 | 5/1977 | Fritz et al. | 266/268 |
| 4,048,352 | 9/1977 | Pignocco et al. | 266/270 |
| 4,139,673 | 2/1979 | Ohmae | 428/336 |
| 4,210,264 | 7/1980 | Kondo | 222/591 |
| 4,385,753 | 5/1983 | Leroy et al. | 266/268 |

FOREIGN PATENT DOCUMENTS

| | | | |
|---|---|---|---|
| 235238 | 11/1959 | Australia | 266/270 |
| 2419584 | 10/1974 | Fed. Rep. of Germany | 266/270 |
| 11013 | 4/1976 | Japan | 266/270 |
| 106704 | 5/1986 | Japan | 266/270 |

OTHER PUBLICATIONS

*The Making, Shaping and Treating of Steel,* United States Steel Corp., 1971, p. 50.

*Primary Examiner*—Robert McDowell
*Attorney, Agent, or Firm*—Stanley Ktorides

[57] ABSTRACT

A tuyere having improved wear resistance at the tip, and a refractory walled metallurgical vessel incorporating the tuyere, characterized by an oxide thermal barrier coating on the outer surface of the outermost conduit of the tuyere having a thermal conductivity less than that of the refractory.

12 Claims, 3 Drawing Sheets

FIG. 1
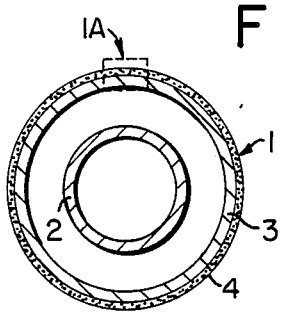
FIG. 1A
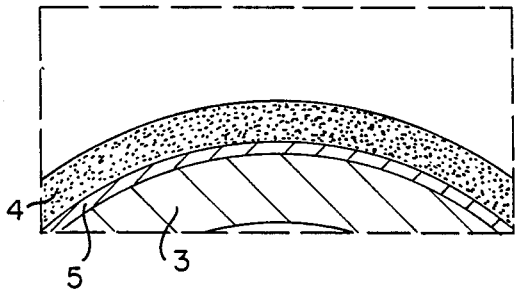
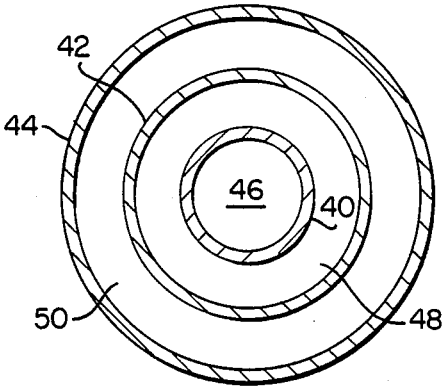
FIG. 3
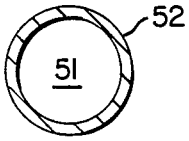
FIG. 4
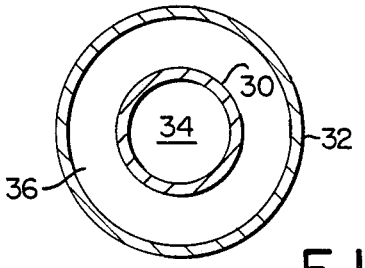
FIG. 2

WEAR RESISTANT METALLURGICAL TUYERE

TECHNICAL FIELD

The invention relates generally to the field of metallurgy wherein gas or gases are passed into a metallurgical vessel through one or more tuyeres and, more particularly, to tuyeres for such use.

BACKGROUND ART

Often, in carrying out metallurgical operations, fluids are passed into the molten metal contained within a metallurgical vessel from below the molten metal surface. Examples of such injection operations include the passage of gas into molten metal to flush out impurities, the passage of gas into molten metal to stir or otherwise agitate the melt, and the passage of gas into molten metal for reaction with melt constituents.

One means by which fluids are passed into the molten metal is through one or more tuyeres which pass through the wall of the metallurgical vessel and which are connected at one end with a source of gas or gases and which at the other end communicate with the vessel interior. Generally the vessel walls are lined with refractory material and the tuyeres pass through and are in contact with this refractory for a portion of their length.

The tuyeres operate under severe conditions, especially at their injection end which contacts the molten metal. For example, the temperature of molten steel generally exceeds about 2500° F. These severe conditions cause the tuyere to wear and eventually to require replacement. The wear occurs at the injection end or tip of the tuyere. It is of course desirable to have a tuyere which will wear more slowly than presently available tuyeres.

When gas injection is used for flushing or stirring, the gas or gases generally employed are inert to the molten metal. However, when a reaction such as decarburization is carried out, the wear problem is more severe because the reactions being carried out at the tuyere tip are generally exothermic. For example, decarburization is usually carried out by the injection of oxygen or oxygen and inert gas into the melt. The very high temperatures caused by the reaction of melt constituents with, for example, oxygen, combined with the vigorous localized agitation caused by the gas injection and reaction, cause extremely severe wear at the tuyere tip when reactive gas injection is carried out.

Those skilled in the art have addressed the problem of severe tuyere wear, especially when a reactive gas is injected, and have devised the annular tuyere directed to the problems. The annular tuyere comprises a central conduit and an annular conduit around and along the central conduit. Such a tuyere most often comprises inner and outer concentric tubes. Reactive gas, such as oxygen, is passed into the melt through the central conduit and an inert gas or liquid, such as argon, nitrogen or a hydrocarbon is passed into the melt through the annular and central passages. The shroud gas serves to shield the tuyere tip from some of the more severe effects of the gas injection and thus to prolong the life of the tuyere by causing it to wear at a slower rate.

A problem which has been observed with annular tuyeres is the tendency of the outer conduit to wear at a faster rate than that of the inner conduit. This reduces to some extent the beneficial wear resistant aspects of the annular tuyere because the wear of the inner conduit is controlled by the wear of the outer conduit. This problem may be addressed by providing yet another annulus around the first annulus, but this solution is costly and is still unsatisfactory since the outermost conduit still exhibits higher wear than the inner conduits.

Accordingly it is an object of this invention to provide a tuyere which exhibits greater wear resistance at the tip than that possible with heretofore available tuyeres.

It is a further object of this invention to provide on annular tuyere which exhibits greater wear resistance at the tip than that possible with heretofore available annular tuyeres.

It is another object of this invention to provide a metallurgical vessel having at least one tuyere which exhibits greater wear resistance at the tip than that possible with heretofore available tuyeres.

SUMMARY OF THE INVENTION

The above and other objects which will become apparent to one skilled in the art upon a reading of this disclosure are attained by the present invention, one aspect of which is:

A tuyere for use in a refractory walled metallurgical vessel, said tuyere comprising at least one conduit and an oxide thermal barrier coating on the outer surface of said conduit, said thermal barrier coating having a thermal conductivity less than that of said refractory.

Another aspect of the invention is:

A metallurgical vessel comprising at least one refractory wall and having at least one tuyere passing through said wall for passage of fluid into the vessel, said tuyere comprising at least one conduit and an oxide thermal barrier coating on the outer surface of said conduit, said thermal barrier coating having a thermal conductivity less than that of said refractory.

BRIEF DESCRIPTION OF THE DRAWINGS

FIG. 1 is a radial cross-sectional representation of one embodiment of the tuyere of this invention.

FIG. 1A is a detail of FIG. 1.

FIG. 2 is a radial cross-sectional view of an annular tuyere of the invention having a single annulus.

FIG. 3 is a radial cross-sectional view of an annular tuyere of the invention having more than one annulus.

FIG. 4 is a radial cross-sectional view of a single conduit tuyere of the invention.

DETAILED DESCRIPTION

Figure 5:
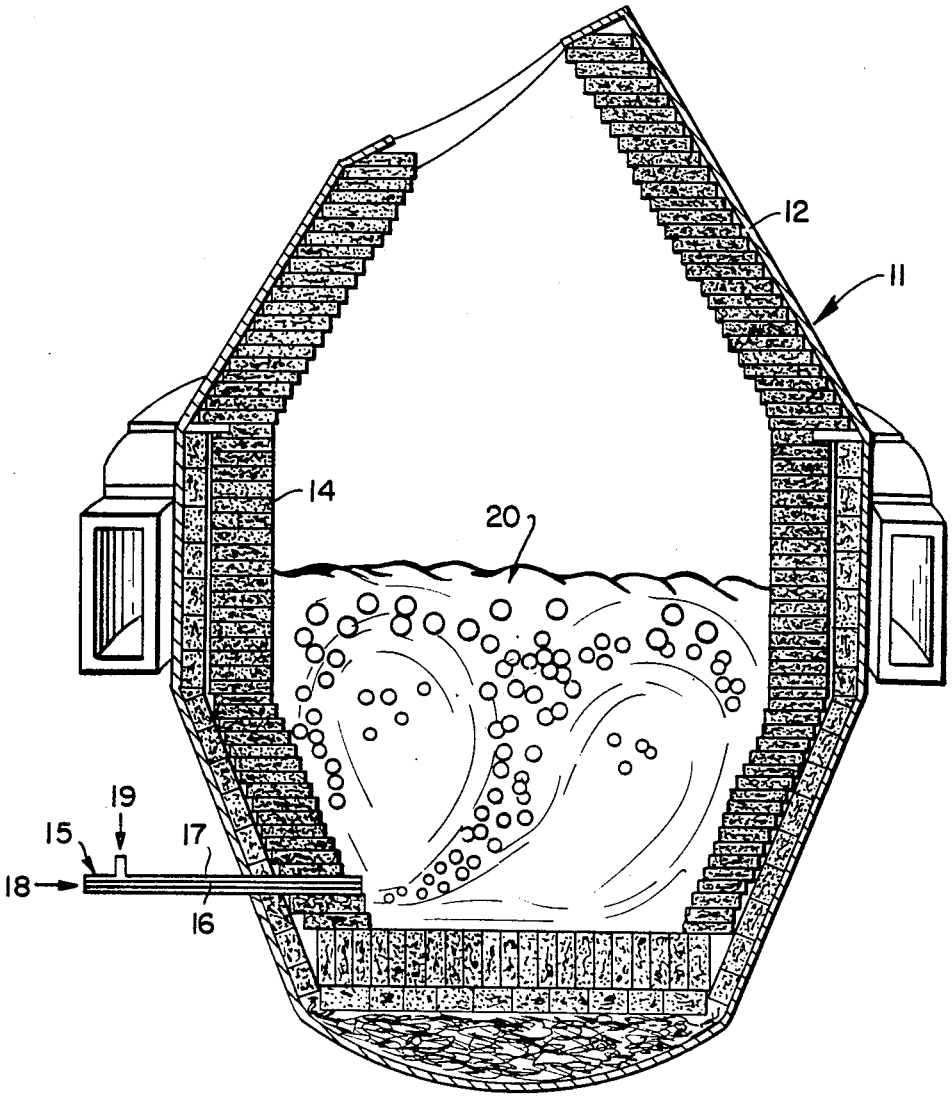
FIG. 5 is a cross-sectional view of a metallurgical vessel of the invention useful for steel refining.

The invention will be described in detail with reference to the Drawings.

Referring now to FIG. 1, annular tuyere 1 comprises central conduit 2 and annular conduit 3 which is around and along central conduit 2. Fluids, generally gases, flow through the central and annular passages and are delivered into a refractory walled metallurgical vessel for refining, mixing and/or flushing, or for other purposes, of the molten material within the vessel. Generally the tuyeres, as shown in the drawings, have circular cross-sections, although tuyeres of any effective cross-sectional shape may be employed in the invention. The conduits are generally made of metal such as carbon steel, stainless steel or copper but may be made of other metals such as titanium, tungsten, nickel, cobalt, and various alloys of these metals.

FIGS. 2, 3 and 4 illustrate radial cross sections of a single annulus, a double annulus tuyere, and a single conduit tuyere, respectively. In FIG. 2, central passage 34 is defined by central conduit 30, and annular passage 36 is defined by central conduit 30 and annular conduit 32. In FIG. 3 central passage 46 is defined by central conduit 40, first annular passage 48 is defined by central conduit 40 and first annular conduit 42, and second annular passage 50 is defined by first annular conduit 42 and second annular conduit 44. In FIG. 4 central passage 51 is defined by conduit 52.

On the outer surface of the outermost annular conduit, i.e., on the outer surface of conduit 3 of FIG. 1, conduit 32 of FIG. 2, conduit 44 of FIG. 3 and conduit 52 of FIG. 4, there is a thermal barrier coating, shown as 4 in FIG. 1, having a thermal conductivity less than that of the refractory wall through which the tuyere passes when delivering fluids into the metallurgical vessel. The thermal barrier coating 4 in FIG. 1 is shown as having an exaggerated thickness for purposes of illustration. Preferably, the thermal conductivity of the thermal barrier coating is not more than about 50 percent of that of the refractory wall because, at thermal conductivities greater than about 50 percent of that of the refractory, a greater thickness of coating must be used, making the coating more susceptible to cracking due to thermal expansion effects and more expensive because of the increased deposition time needed to apply the coating. As used herein, the term "thermal conductivity" means the characteristic rate at which heat is conducted through the thermal barrier per unit surface area and temperature difference between the inner and outer surfaces of the barrier.

FIG. 1A is a detail view of FIG. 1 showing thermal barrier coating 4 covering the outer surface of conduit 3. Between thermal barrier coating 4 and conduit 3 is metallic undercoating layer 5 of which more will be said later.

The thermal barrier coating useful with this invention comprises one or more oxides. Among such oxides one can name zirconia, partially stabilized zirconia, fully stabilized zirconia, hafnia, titania, silica, magnesia, alumina and chromia, along with mixtures and compounds thereof. Partial or full stabilization of zirconia can be achieved by the addition of calcia, magnesia, yttria, ceria, or other rare earth oxides.

The thermal barrier coating may comprise a single layer of oxide or may comprise layers of different oxides. Preferably, between the thermal barrier coating and the outer conduit of the tuyere there is a metallic undercoating. Because of the difference in the microstructure between a thermally sprayed coating and a solid substrate, the difference in bond strengths between an oxide to a metallic substrate and a metallic coating to a solid substrate, and because of the topography of the metallic undercoating, such metallic undercoating will serve to increase the adherence of the thermal barrier coating upon the tuyere. Adherence is further improved if the metallic undercoating has a coefficient of thermal expansion which is between those of the oxide coating and the metallic conduit of the tuyere. The metallic undercoating serves to improve the adherence of the oxide coating to the metallic tuyere by providing a bridging layer to avoid spalling the oxide layer off the tuyere. The coating on the tuyere may also comprise a metallic undercoat followed by one or more layers of a mixture of metal and oxide with increasing amounts of oxide in the outer layers, or followed by a zone with a continuous gradation from pure metal to pure oxide culminating in a pure oxide outer layer.

Preferably, the coating on the outside surface of the tuyere comprises a metallic undercoating and a single layer of oxide thermal barrier coating.

Among the metallic compounds useful for employment in the metallic undercoating one can name cobalt or nickel base surperalloys, nickel-chromium alloys, nickel-based alloys such as nickel aluminides, copper-based alloys and iron-based alloys such as stainless steel.

The coating system may be generated by any number of means or combinations of means including physical vapor deposition, electrodeposition, slurry techniques, and solgel techniques, but the preferred method is by thermal spraying. The specific thermal spray techniques that may be used include flame spraying, plasma deposition, detonation gun deposition, hypersonic velocity deposition and the like. The most preferred technique is by non-transferred arc plasma deposition. In this technique, a high velocity ionized gas stream (plasma) is generated as a result of electric arc discharge between a tungsten cathode and a water cooled copper anode which ionizes a gas (usually argon that may or may not contain additions of nitrogen, hydrogen, or helium). Into this high velocity, high temperature gas stream a flow of fine particles of the oxide and/or metal being used to produce the coating is introduced. The powder particles are heated to near or above their melting point and accelerated to a velocity that typically ranges from 1,000 to 2,000 ft/sec. The molten droplets of oxide or metal impinge on the surface to be coated where they flow into tiny splats which are tightly bonded to the substrate and to each other forming a rapidly solidified thin lenticular microstructure.

The thickness of the oxide thermal barrier coating on the outer surface of the tuyere of this invention will vary and will depend, inter alia, on the particular composition of the thermal barrier coating, on the type of refractory and on the particular metallurgical operation involved. The coating thickness will generally be within the range of from 0.005 to 0.200 inch and preferably within the range of from 0.010 to 0.050 inch. If used, the thickness of the metallic undercoating will generally be within the range of from 0.001 to 0.010 inch.

FIG. 5 illustrates a refractory walled metallurgical vessel for steel refining. In this case the vessel is an argon-oxygen decarburization (AOD) vessel. Referring now to FIG. 5, vessel 11 comprises a metal shell 12 which is lined on the inside with refractory 14. In this case the refractory 14 comprises bricks although monolithic refractory types, such as a one piece refractory shape, and castable, rammed or vibratable refractory types, may be used. Refractories for metallurgical vessels are well known and include silica brick, sandstone, fused silica, semi-silica brick, fireclay, high alumina brick or monolith, dolomite magnesite-chrome and carbon brick. Generally such refractories have a thermal conductivity within the range of from 2 to 50 BTU/hr/ft$^2$/° F./inch. Annular tuyere 15 is comprised of central conduit 16 and annular conduit 17 through which pass fluids 18 and 19 respectively into melt 20 within the interior of vessel 11. Although not shown, it is understood that tuyere 15 is connected to sources of such fluids. For example, in carrying out AOD refining, oxygen gas may be supplied to melt 20 through the passage formed by central conduit 16 and an inert gas such as argon or nitrogen may be supplied to melt 20 through the annular passage as well as through the central passage. On the outer surface of annular conduit 17 is the oxide thermal barrier coating suitable for use with this invention. As can be seen from FIG. 5, the thermal barrier coating may be in contact with refractory 14 through which tuyere 15 passes. Preferably there is no air gap between the tuyere and the refractory through which it passes so that no molten metal can pass into contact with the tuyere at these points. Accordingly, there is preferably a contiguous boundary between the thermal barrier coating and the refractory for a substantial portion of their common adjacent area.

Figure 6:
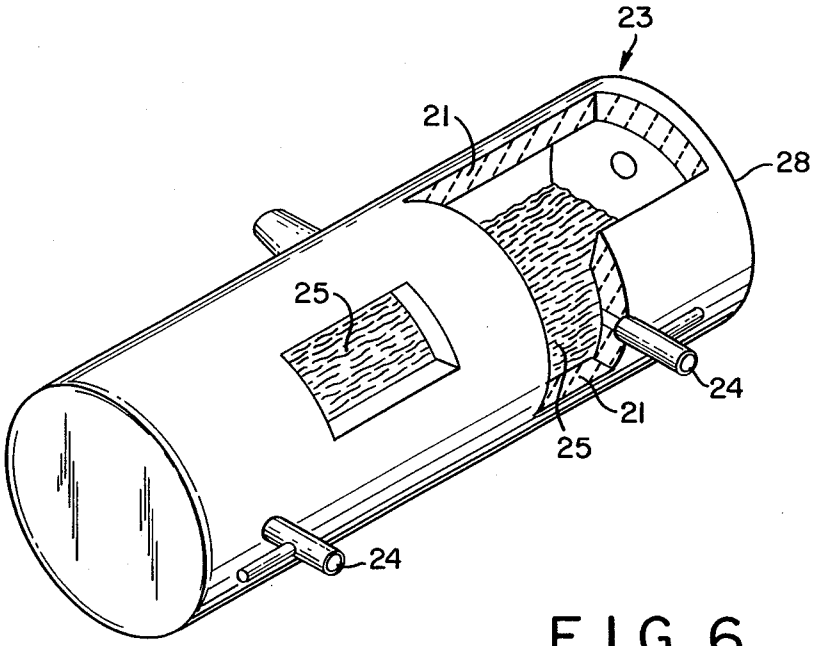
FIG. 6 is a cut away view of a metallurgical vessel of the invention useful for copper refining.

FIG. 6 illustrates another refractory-walled metallurgical vessel, in this case for copper refining. Referring now to FIG. 6, vessel 23 comprises metal shell 28 which is lined on the inside with refractory 21, such as described with reference to FIG. 5. Annular tuyeres 24, connected to sources of fluids (not shown) pass through refractory 21 and provide fluids, such as refining gases, into melt 25. On the outer surface of annular tuyeres 24 is the oxide thermal barrier coating suitable for use with this invention and which is shown as being in contiguous contact with refractory 21 through which tuyeres 24 pass.

The following Example and comparative example serve to further illustrate the invention and the advantages attainable thereby and are not intended to be limiting.

EXAMPLE

A steel refining vessel similar to that illustrated in FIG. 5 was used to decarburize molten steel by the injection thereinto of oxygen, nitrogen and argon. The vessel had a refractory brick wall of magnesite-chrome refractory which had a composition by weight of 55 parts MgO, 20 parts $Cr_2O_3$, 8 parts $Al_2O_3$, 11 parts FeO, and 2.5 parts $SiO_2$, and which had a thermal conductivity of about 26 BTU/hr/ft$^2$/° F./inch. The refining gases were passed into the molten steel through an annular tuyere of this invention with oxygen gas passing through the central passage and nitrogen and argon gases passing through the annular and central passages. The tuyere was made of a copper inner conduit and a stainless steel outer conduit. The outer surface of the annular conduit of the tuyere was coated with a 0.011 inch thick coating of yttria stabilized zirconia which had a composition by weight of 92 parts $ZrO_2$ and 8 parts $Y_2O_3$, and which had a thermal conductivity of about 8 BTU/hr./ft$^2$/° F./inch. Between the oxide thermal barrier coating and the tuyere was a 0.002 inch thick metallic undercoating of an alloy of by weight Co-32Ni-21Cr-8AL-0.5Y.

The refining vessel was used to refine steel of about 27 tons per heat or load. With each heat the tip of the tuyere was worn away somewhat by the erosive conditions at the tip. Sixty heats of steel were refined before the tuyere had worn away to the point where the tuyere required replacement.

For comparative purposes the above-described procedure was repeated except that the tuyere had no thermal barrier coating or metallic undercoating on its outer surface. Only 54 heats of steel could be refined before the tuyere had worn away to the point where the tuyere required replacement.

As demonstrated by the reported Example and comparative example, the invention enables an increase in the amount of steel, in this specific case about 11 percent, which could be refined before tuyere replacement is necessary, thus increasing the overall efficiency of the metal treating operation.

It is surprising that tuyere wear at the tip is significantly reduced even though there is no shielding or other protective measure of the outermost conduit from the effects of the molten metal itself. While not wishing to be held to any theory, applicants believe the beneficial effects are achieved, at least in part, by the differential in the thermal conductivity between the refractory and the thermal barrier coating, causing a reduction in heat flux from the refractory, which is heated by the melt, into the tuyere and thus into the fluids passing through the tuyere. Accordingly, the fluid passing through the outermost conduit is not heated as much by heat flux from the refractory, which itself is heated by the melt, and, thus, this fluid retains a lower temperature when delivered to the tuyere tip so as to serve as a coolant to the tip with respect to the melt. In addition, there is a reduction in heat flux to the tip of the tuyere from the surrounding refractory which further lowers the temperature of the tuyere tip resulting in increased life.

Although the invention has been described in detail with respect to certain embodiments, those skilled in the art will recognize that there are other embodiments of the invention within the spirit and scope of the claims.

We claim:

1. A coaxial tuyere for use in a refractory walled metallurgical vessel, said tuyere comprising a central conduit and at least one conduit outer and coaxial thereto, each of said conduits having an outer surface and further comprising an oxide thermal barrier coating on the outer surface of the outermost coaxial conduit.

2. The tuyere of claim 1 wherein the oxide thermal barrier coating has a thickness within the range of from 0.005 to 0.200 inch.

3. The tuyere of claim 1 wherein the oxide thermal barrier coating is from the group consisting of zirconia, partially stabilized zirconia, fully stabilized zirconia, hafnia, titania, silica, magnesia, alumina, chromia, mixtures thereof, and compounds thereof.

4. The tuyere of claim 1 further comprising a metallic undercoating between the outer surface of said conduit and the oxide thermal barrier coating.

5. The tuyere of claim 4 wherein between the metallic undercoating and the oxide thermal barrier coating there is at least one layer of a mixture of metal and oxide.

6. A metallurgical vessel comprising at least one refractory wall and having at least one coaxial tuyere passing through said wall for passage of fluid into the vessel, said tuyere comprising a central conduit and at least one conduit outer and coaxial thereto, each of said conduits having an outer surface and further comprising an oxide thermal barrier coating on the outer surface of the outermost coaxial conduit, said thermal barrier coating having a thermal conductivity less than that of said refractory.

7. The vessel of claim 6 wherein the thermal conductivity of the oxide thermal barrier coating is not more than 50 percent of that of the refractory.

8. The vessel of claim 6 wherein the oxide thermal barrier coating has a thickness within the range of from 0.005 to 0.200 inch.

9. The vessel of claim 1 wherein the oxide thermal barrier coating forms a contiguous boundary in contact with the refractory through which the tuyere passes for a portion of their common adjacent area.

10. The vessel of claim 1 wherein the oxide thermal barrier coating is from the group consisting of zirconia, partially stabilized zirconia, fully stabilized zirconia, hafnia, titania, silica, magnesia, alumina, chromia, mixtures thereof, and compounds thereof.

11. The vessel of claim 6 further comprising a metallic undercoating between the outer surface of said conduit and the oxide thermal barrier coating.

12. The vessel of claim 11 wherein between the metallic undercoating and the oxide thermal barrier coating there is at least one layer of a mixture of metal and oxide.

* * * * *